United States Patent [19]

Feldkamper

[11] 3,946,644

[45] Mar. 30, 1976

[54] APPARATUS FOR SPREADING OPEN CROSS-BOTTOMS ON TUBULAR MEMBERS

[75] Inventor: Richard Feldkämper, Lengerich, Germany

[73] Assignee: Windmoller & Holscher, Lengerich, Germany

[22] Filed: May 8, 1974

[21] Appl. No.: 468,167

[30] Foreign Application Priority Data

May 10, 1973 Germany ..... 2323727

[52] U.S. Cl. ..... 93/28

[51] Int. Cl.[2] ..... B31B 1/76

[58] Field of Search ..... 93/28, 29, 30, 14, 15, 93/16, 17, 21, 22, 23, 24, 25, 8 R, 32

[56] References Cited

UNITED STATES PATENTS

| | | | |
|---|---|---|---|
| 925,296 | 6/1909 | Claussen | 93/30 X |
| 1,020,773 | 3/1912 | Müller | 93/16 |
| 2,570,047 | 10/1951 | Burroughs | 93/22 |
| 3,793,927 | 2/1974 | Emond | 93/8 R X |
| 3,803,989 | 4/1974 | Kuckhermann et al. | 93/28 |

*Primary Examiner*—James F. Coan

*Attorney, Agent, or Firm*—Fleit & Jacobson

[57] ABSTRACT

The invention relates to apparatus for spreading open cross-bottoms on conveyed tubular members which are to be further processed to form bags or sacks, the apparatus having two spreader members which rotate sunchronously and symmetrically relative to the plane of the tube ends to be formed and which are driven by way of a non-uniformity drive transmission and which engage into the tube ends for spreading thereof, the degree of non-uniformity of the drive movement produced by the non-uniformity drive transmission and the phase position of the non-uniformity thereof being adjustable.

6 Claims, 5 Drawing Figures

APPARATUS FOR SPREADING OPEN CROSS-BOTTOMS ON TUBULAR MEMBERS

BACKGROUND OF THE INVENTION

The invention relates to an apparatus for spreading open cross-bottoms on tubular members which are to be further processed to form cross-bottom sacks or bags, said apparatus having two spreader members which rotate synchronously and symmetrically relative to the plane of the tube ends to be formed and which are driven by a nonuniformity drive transmission and which engage into and spread open the tube ends.

An apparatus of this kind is known from the applicant's German Pat. No. 2,062,944 in which crescent-shaped spreader members which rotate about shafts which are made pivotal by means of a universal joint, even during operation, can be driven by way of a non-uniformity drive transmission. In this apparatus the pivotal movement of the spreader members about axes extending parallel to the direction of conveyance of the tube portions, in the direction of increasing the angle of inclination of the spreader members, serves to improve the spreading operation by adaptation of the spreading movement which is on an elliptical path in projection on the bag or sack bottom to be opened. The ellipse of the path is distorted by the pivotal movement, into an approximation to the ideal spreading movement. In the known apparatus provision is also made for pivotability of the axis of the spreader members so that they are pivotal on a subatantially conical path about the straight line extending through the two pivot points, in the direction of displacing the point of closest approach of the spreader members on a circular track which lies in the plane of conveyance of the ends of the tube portions. By means of this pivotability, the path of movement of the spreader members can be varied to provide for the best possible entry into the ends of the tube portions, and good forming of the bottom folds. The curved paths of the spreader members are to be so adjusted or to be varied by pivotal movement that the spreader members engage into the tube portion as it passes by, with as great as possible an approach of the crescent members, and stretch the corner tucks out as well as possible, by approaching the fold edges thereof. When the corners of large bottom squares are to be extended, it is at any event advantageous to pivot the shafts of the spreader members during the rotation thereof, to provide for a good stretching movement. While the above-described modes of pivotal movement of the shafts of the spreader members provide for optimum adaptation of their curved paths to the spreading operation, the non-uniform drive for the shafts of the spreader members, which is due to the universal joints, can be utilised for increasingly reducing their peripheral speed as they pass into the tube opening and for increasing their peripheral speed as they come out of the tube opening again, so that the peripheral speed component of the spreader members in the direction of conveyance of the tube portions substantially coincides with their speed of conveyance. It is necessary for the speed of the rotating spreader members to be closely adapted to the speed of the tube portions as they pass, in order to ensure that the corner tucks are satisfactorily smoothed out and in order to prevent the spreading members from becoming hooked up, for example when forming the rear corner tuck. The universal joints which are used in the known apparatuses must be connected to the shafts of the spreader members at a rotary angle such that the non-uniformity in the drive to the spreader members, which is caused by the universal joints, is utilised to comply with the conditions required. Only if the non-uniform drive movement as predetermined by the universal joint is not sufficient, is a non-uniformity drive transmission provided in the known apparatuses. The rotary angular position of the non-umiformity drive transmission relative to the universal joints is so selected that its non-uniformity movement is added to or subtracted from that of the universal joints, as required, in order to achieve with a good degree of approximation the non-uniform peripheral speed required for synchronising the spreader members with the tube portion and for producing the spreading movement thereof. In the known apparatus adapting the non-uniform peripheral speed of the spreader members to the throughpassage speed of the tube members involves substantial difficulties as the degree of non-uniformity of the speed of movement and the phase position of the non-uniformity are predetermined, due to the structure involved, because of the use of universal joints. In order to provide for easy handling and multi-purpose use of the apparatus however, it is desirable to be able to adjust the spreader members easily to different bottom configurations.

SUMMARY OF THE INVENTION

It is therefore the problem of the invention to provide an apparatus for opening cross-bottoms in which the spreading and stretching movement of the spreader members can be co-ordinated to the optimum extent and in a simple manner, with the through-passage movement of the tube portions.

According to the present invention there is provided apparatus for spreading open cross-bottoms on coveyed tubular members which are to be further processed to form bags or sacks, comprising two spreader members which rotate synchronously and symmetrically relative to the plane of the tube ends to be formed and which are driven by way of a non-uniformity drive transmission and which engage into the tube ends for spreading thereof, the degree of non-uniformity of the drive movement produced by the non-uniformity drive transmission, and the phase position of the non-uniformity thereof, being adjustable.

The adjustability according to the invention of the degree and the phase position of the non-uniform drive movement makes it possible for the apparatus to be adjusted in a simple manner when there is a change in the format of the cross-bottoms to be opened, while the desired movement of the spreader members can be observed when the apparatus is running slowly and can be adapted in a simple manner to the cross-bottoms to be produced. The apparatus according to the invention permits tidy folding of cross-bottoms as it is sufficient, to form the front corner tuck, for the leading ends of the spreader members which are advantageously of a T-shaped construction, to stretch out of the tube opening symmetrically approximately to the full width only at the rear edge of the front corner tuck, and for the spreading stretching movement of the trailing ends of the spreader members to be more precisely adjusted to the fold edges to be formed on the rear corner tuck. It should be noted in this respect that the spreader members must come out of the rear corner tuck again at a higher speed, in order to prevent becoming hooked up with the corner tucks.

A drive transmission which is suitable for adjusting the degree of non-uniformity and also the phase position thereof is characterised in accordance with the invention in that a crank is fixedly connected to its input drive shaft, a shaft being mounted rotatably at the free end of the crank and being connected at its side which is towards the drive to a gearwheel which engages with a gearwheel which is mounted rotatably on the drive shaft and which is connected to a drive gearwheel arranged concentrically to the gearwheel, to form a double gearwheel, while on the other side the shaft carries a coupling means in which there slides a slide block which is arranged fixed with respect to the machine and whose spacing and angular position relative to the drive shaft is adjustable. As the coupling means is arranged movably and the slide block is arranged fixed with respect to the machine, the non-uniformity and the phase position thereof can be continuously adjusted during the operating movement, by adjustment of the slide block in suitable guides.

For the purposes of varying the degree of non-uniformity, in a further embodiment of the invention it is provided that the spacing of the slide block from the drive shaft can be adjusted by means of a spindle actuating means. In a preferred embodiment of the invention the phase position of the non-uniformity in the drive movement can be adjusted by the slide block being arranged in a frame which is rotatable by way of a spindle actuating means. The apparatus for adjusting the radial spacing of the slide block from the drive shaft is advantageously arranged in a frame which is rotatable therearound. In order to prevent unintentional displacement of the slide block during operation, there can be provided a tightening means for preventing such displaceability.

BRIEF DESCRIPTION OF THE DRAWINGS

To the accomplishment of the foregoing and related ends, the invention then comprises the features hereafter fully described and particularly pointed out in the claims, the following description and annexed drawings setting forth in detail a certain illustrative embodiment of the invention, this being indicative however, of but one way in which the principle of the invention may be employed.

In said annexed drawings.

DESCRIPTION OF THE PREFERRED EMBODIMENT

Figure 1:
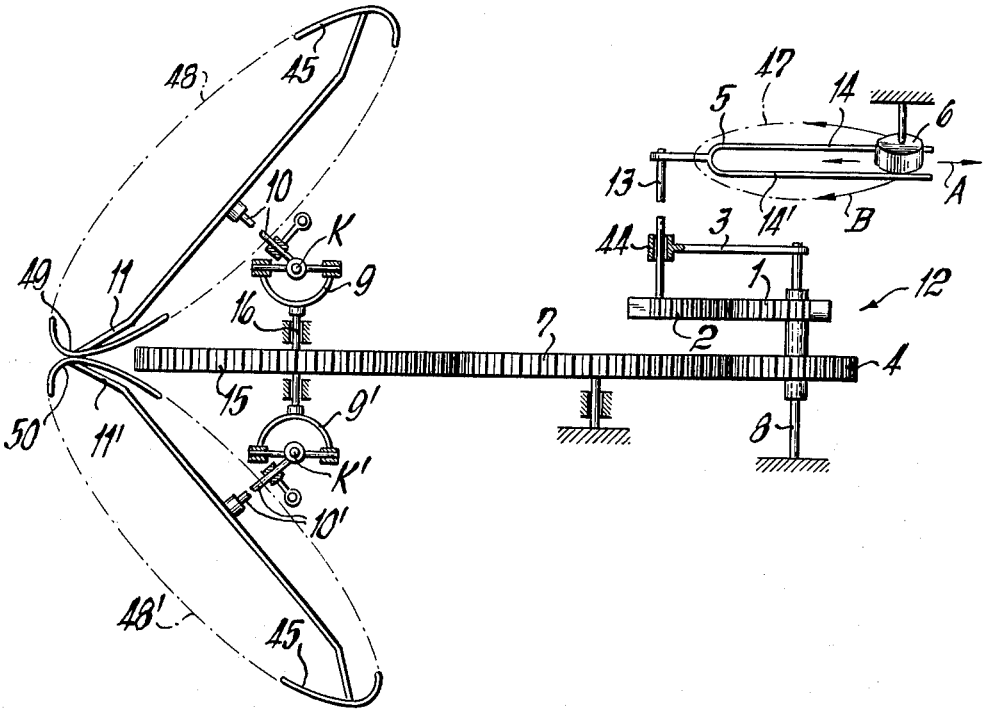
FIG. 1 is a diagrammatic representation, partly in side view, partly in plan view and partly in perspective view, of the spreader members which rotate about pivotal axes, with an adjustable non-uniformity transmission.

As shown in the diagrammatic representation of FIG. 1, shafts 10 and 10′ of the spreader members 11 and 11′, with the circular segment-shaped crescent 45, are pivotable about pivot points K, K′ of universal joints 9 and 9′ which are driven by a non-uniformity drive transmission 12. This drive transmission 12 comprises an input shaft 8 which is mounted in a cover 18 (FIG. 4) of a transmission housing 46 and which at its free end is fixedly connected to a crank 3 which is arranged at a right angle. At its free end the crank 3 has a bearing bore 44 in which a shaft 13 is mounted so as to be pivotal but axially non-displaceable. At its end which is towards the drive side the shaft 13 is connected to a toothed wheel segment 2 which in turn engages with the tooth wheel segment 1 which is rotatably mounted on the drive shaft 8. At the opposite end the shaft 13 carries a coupling member 5 which is arranged perpendicularly to the shaft and which has fork-like limbs 14 and 14′. The limbs 14 and 14′ embrace a slide block 6 which is mounted in the machine frame so as to be displaceable on a circular track 47 concentric to the drive shaft 8, and on a guide which forms the diameter of the circular track. A gearwheel 4 is connected concentrically to the segment 1 which is rotatably mounted on the drive shaft 8. The gearwheel 4 engages by way of an intermediate wheel 7 with a gearwheel 15 which is fixed on a shaft 16 which carries the universal joints 9 and 9′. In order to vary the degree of non-uniformity in the drive transmission, the slide block 6 is adjustable as regards its radial spacing relative to the drive shaft 8 in the direction of the double arrow A. For the purposes of adjusting the phase position of the non-uniformity, the slide block 6 is displaceable on the circular track 47 which is concentric to the drive shaft 8 and which is indicated in perspective view in FIG. 1 by the double arrow B and the broken line. The part of the non-uniformity drive transmission 12 which is above the shaft line in FIG. 1 is illustrated in perspective.

Figure 2:
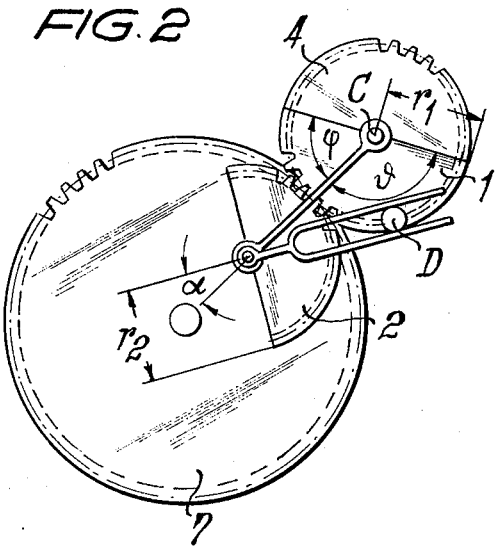
FIG. 2 shows a plan view of the non-uniformity transmission of FIG. 1.
Figure 3:
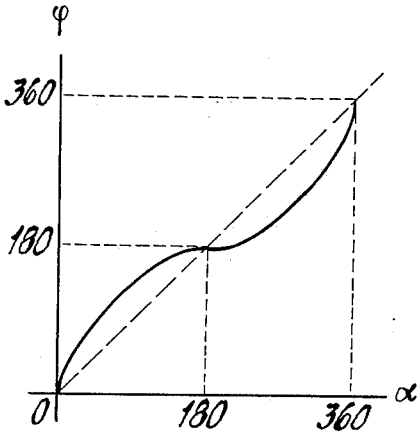
FIG. 3 shows a diagram representing the non-uniformity pattern.

If, as shown in FIG. 2, the rotary angle of the drive is denoted by $\phi$, the rotary angle of the output gearwheel 4 is as follows:

$$\theta = \phi + \alpha r_2/r_1,$$

wherein $\alpha$ is the angle included by the crank 3 and the coupling means 5, $r_1$ is the radius of the toothed wheel segment 1, and $r_2$ is the radius of the segment 2. FIG. 2 also shows that the variation in the angle $\theta$ with the rotary angle $\phi$ of the drive is dependent alone on the distance CD, C being the drive shaft 8 and D being the axis of the slide block 6, that is to say, the instantaneous point of rotation of the coupling means 5. If the point D co-incides with the point C, the angle $\alpha$ is always equal to zero so that there is no non-uniformity and the pinion 4 rotates at the same angular speed as the shaft 8. The non-uniformity of the rotary angle $\theta$ of the output in dependence on the angle $\alpha$ can be seen on a qualitative basis in the graph of FIG. 3.

The curved paths, which are in the form of an ellipse in plan view, of the crescent-shaped circular segments 45 arranged at the ends of the spreader members 11 and 11′ are shown in the left-hand part of FIG. 1, above and below the shaft line, by means of the ellipses 48 and 48′ respectively.

Figure 4:
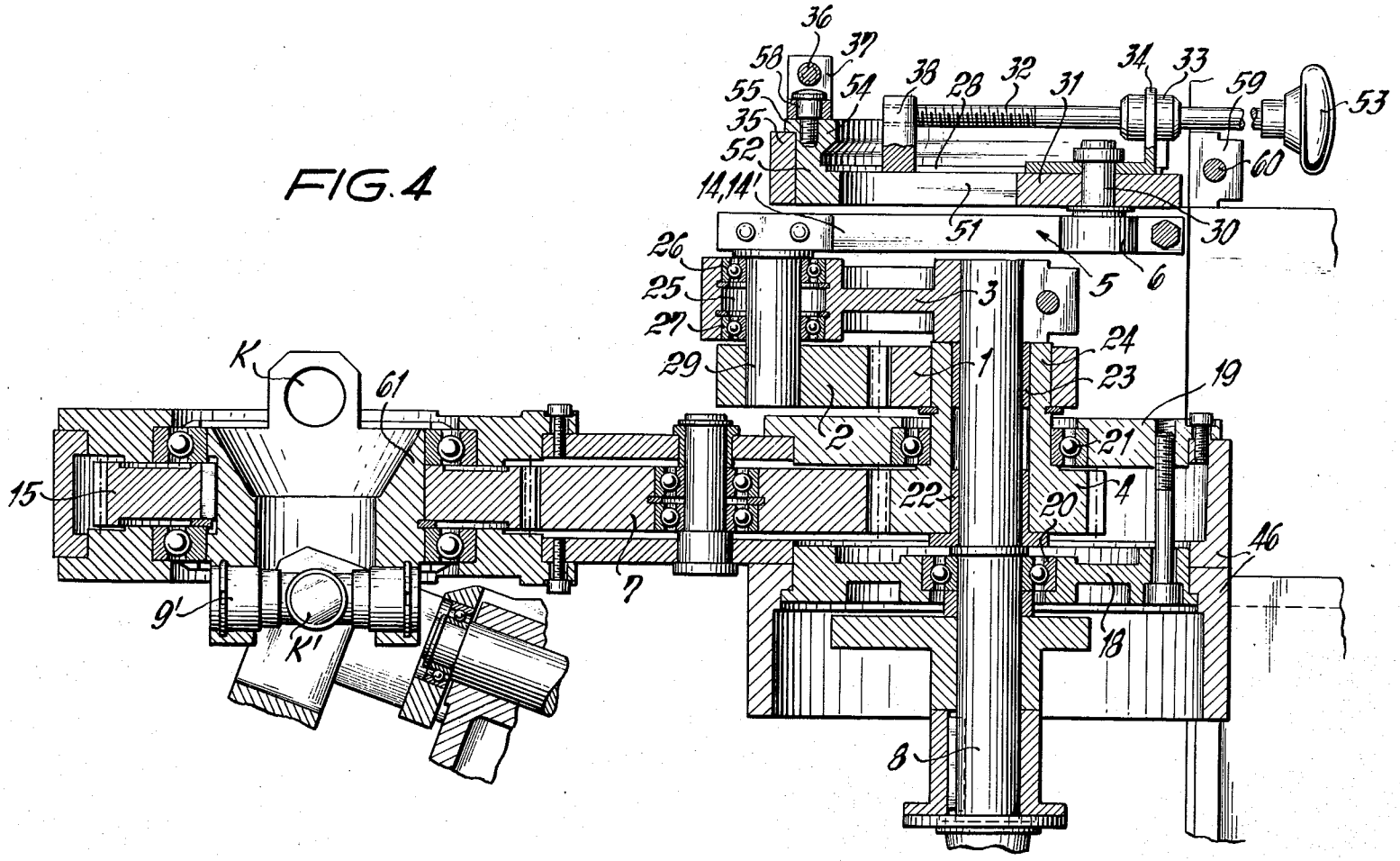
FIG. 4 shows a more detailed view of the apparatus, corresponding to the view in FIG. 1.
Figure 5:
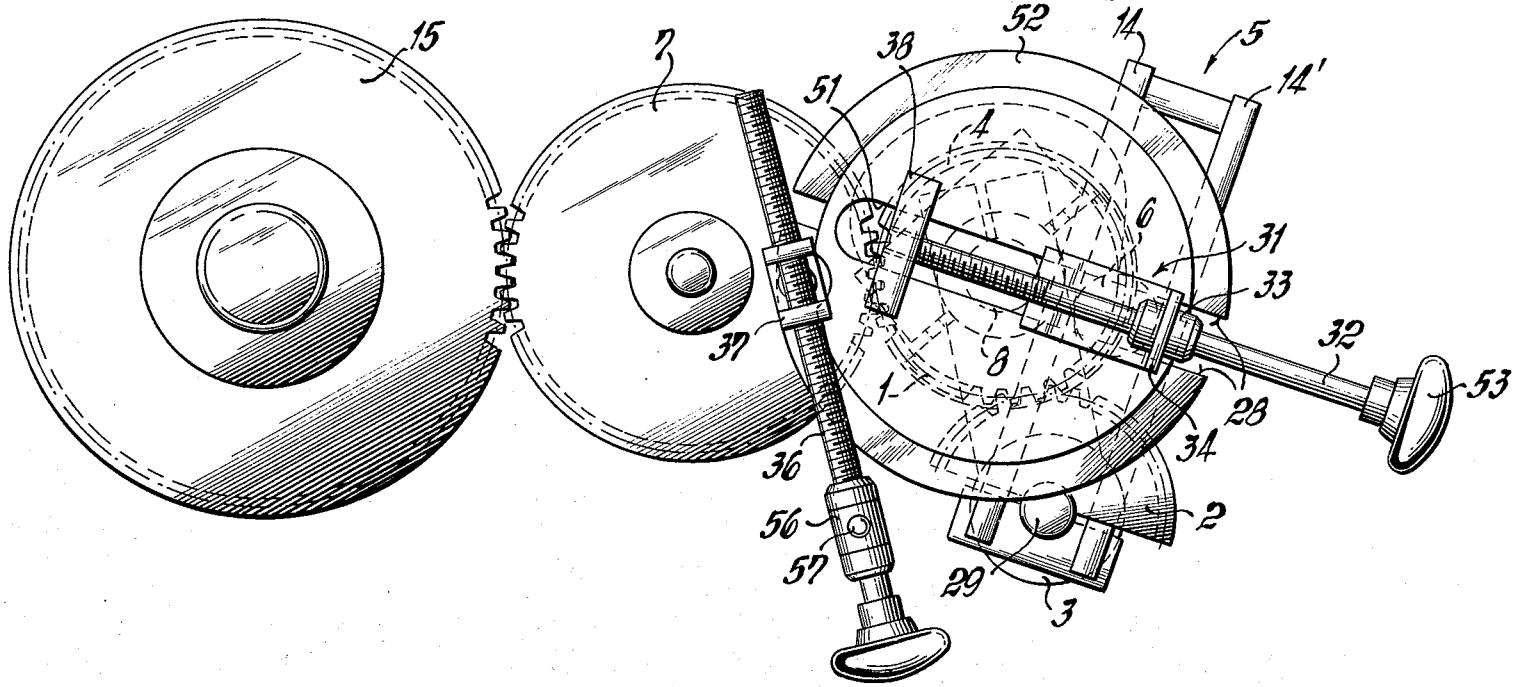
FIG. 5 shows a plan view of the apparatus shown in FIG. 4.

The non-uniformity drive for the spreader members 11 and 11′ and the adjusting means are shown in greater detail in FIGS. 4 and 5. The drive shaft 8 is mounted in the housing covers 18 and 19 by means of the ball bearings 20 and 21. The output gearwheel 4 is mounted on the drive shaft 8 by means of bearings 22 and 23. The toothed wheel segment 1 is secured on the hub of the gearwheel 4, which is extended in the manner of a bush. The hub 24 and thus indirectly also the drive shaft 8 are mounted in the housing cover 19 by means of ball bearing 21. The toothed wheel segment 1 is secured outside the mounting cover 19 on the hub 24. The crank 3 is fixedly connected to the free end of the drive shaft 8, while at its free end the crank 3 is provided with the mounting bore 25 in which the shaft 29 is mounted by means of the ball bearings 26 and 27. At its lower end the shaft 29 is fixedly connected to the segment 2 while at its upper end it is fixedly connected to the coupling means 5. The slide block 6 which comprises a ball or roller bearing slides in the fork-like limbs 14 and 14'. The slide block 6 is mounted on the shaft 3 which is secured in a carrier member 41 which is displaceable in the guide 28. The guide 28 is formed by the edges of the elongate slot 51 (FIG. 5) formed in the disc 52. The centre point of the disc 52 co-incides with the centre line of the drive shaft 8. The center line of the elongate slot 51 forming the guide for the carrier member 311 extends on a diametral line of the disc 52. A spindle actuating means 32 and 33 is provided for displacing the carrier member 31 in its guides 28. The end of the spindle 32 is mounted rotatably in the block 38 which is secured on the disc 52 transversely to the elongate aperture 51. The spindle nut 33 is connected to the angularly bent holder 34 which is secured on the carrier member 31. The spindle 32 has a rotary knob 53 for actuating the spindle. The disc 52 is mounted in an annular frame 35 which is fixed with respect to the machine and in which the disc 52 can be rotated by means of the spindle 36 with spindle nut 37. The disc 52 has an upwardly extended edge portion 54 which at its upper outward face is provided with a shoulder 55. The edge portion 54 is supported by means of the shoulder 55, and with its cylindrical outside surface, on the annular frame 35. The spindle 36 is mounted in the bush 56 so as to be rotatable but axially non-displaceable. The bush 56 is pivotal about the shaft 57 which is fixed relative to the machine. The spindle nut 37 is pivotal about the pin 58 which is fixed on the edge portion 54.

The annular frame 35 has a slot 59 by means of which the disc 52 can be locked with the screw means 60. By tightening the screw means 60 the slot-shaped aperture 51 and thus the carrier member 31 in its guides 28 are gripped fast.

FIG. 4 also shows the gearwheels 7 and 15 which drive the spreader members, and the pivot points K and K' of the universal joints, which are disposed on the shaft 61.

Other modes of applying the principle of the invention may be employed, change being made as regards the details described, provided the features stated in any of the following claims, or the equivalent of such, be employed.

I, therefore, particularly point out and distinctly claim as my invention:

1. Apparatus for spreading cross-bottoms on conveyed tubular members which are to be further processed to form bags or sacks, comprising: two spreader members which rotate synchronously and symmetrically relative to the plane of the tube ends to be formed and which engage into the tube ends for spreading thereof; a non-uniformity drive transmission means driving said spreader members; means for adjusting the degree of non-uniformity of the drive movement produced by the non-uniformity drive transmission means; and means for adjusting the phase position of the nonuniformity of said transmission means.

2. Apparatus as claimed in claim 1, in which the drive transmission comprises a drive shaft, a crank fixedly connected to the drive shaft, a shaft rotatably mounted at the free end of the crank and being connected to a gearwheel which engages with a gearwheel which is rotatably mounted on said drive shaft, said gearwheel in said shaft being connected to an output gearwheel which is arranged concentrically to said gearwheel on said shaft, said shaft mounted on said crank being provided with a coupling means in which slides a slide block which is fixed relative to the machine, the spacing and the angular position of the slide block relative to the drive shaft being adjustable.

3. Apparatus as claimed in claim 2, in which the spacing of the slide block from the axis of the drive shaft is adjusted by means of a spindle actuating means.

4. Apparatus as claimed in claim 2, in which the slide block is arranged in a carrier which is rotatable by way of a spindle actuating means.

5. Apparatus as claimed in claim 2, in which the means for adjusting the radial spacing of the slide block from the axis of the drive shaft is arranged in a carrier which is rotatable therearound.

6. Apparatus as claimed in claim 2, in which there is provided a tightening means for preventing displacement of the slide block.

* * * * *